US008586196B2

(12) United States Patent
Hoshi et al.

(10) Patent No.: US 8,586,196 B2
(45) Date of Patent: Nov. 19, 2013

(54) ALUMINUM PLATED FILM AND METALLIC MEMBER

(75) Inventors: Hiroyuki Hoshi, Saitama (JP); Atsushi Okamoto, Saitama (JP); Setsuo Andou, Saitama (JP)

(73) Assignee: Hitachi Metals, Ltd., Tokyo (JP)

( * ) Notice: Subject to any disclaimer, the term of this patent is extended or adjusted under 35 U.S.C. 154(b) by 0 days.

(21) Appl. No.: 13/567,402

(22) Filed: Aug. 6, 2012

(65) Prior Publication Data

US 2012/0298514 A1 Nov. 29, 2012

Related U.S. Application Data

(62) Division of application No. 12/308,684, filed as application No. PCT/JP2007/062686 on Jun. 25, 2007, now Pat. No. 8,262,893.

(30) Foreign Application Priority Data

Jun. 29, 2006 (JP) ..... 2006-180289
Apr. 10, 2007 (JP) ..... 2007-102353

(51) Int. Cl.
*B32B 15/04* (2006.01)
*B32B 15/20* (2006.01)
*C22C 21/00* (2006.01)

(52) U.S. Cl.
USPC ..... 428/650; 428/629; 428/687; 420/528

(58) Field of Classification Search
USPC ..... 428/650, 651, 652, 653, 654, 687, 629, 428/630, 631, 632, 633
See application file for complete search history.

(56) References Cited

U.S. PATENT DOCUMENTS 4,257,854 A 3/1981 Daenen et al.
2007/0009661 A1 * 1/2007 Aizawa et al. ..... 427/299

FOREIGN PATENT DOCUMENTS

EP 1 591 551 A1 11/2005
JP 10-144159 5/1998
JP 11-343555 A 12/1999
JP 2001-040496 2/2001
JP 2004-076031 3/2004
JP 2004-076031 A 3/2004
JP 2004-346372 A 12/2004
JP 2005-031485 2/2005
JP 2006-161154 6/2006

OTHER PUBLICATIONS

Machine Translation, Junichi et al., JP 11-343555, Dec. 1999.*
J. Fransaer et al. "Aluminium composite coatings containing micrometre and nanometre-sized . . . " Journal of Applied Electrochemstry; vol. 32: pp. 123-128; 2002.
Birkle S; "Elektrochemische Al-Abscheidung"; Metalloberflache; Nov. 1, 1988; pp. 511-517; vol. 42, No. 11; Carl Hanser Verlag; Munchen, DE.

* cited by examiner

*Primary Examiner* — Michael La Villa
(74) *Attorney, Agent, or Firm* — Paul F. Neils; Edwards Neils PLLC

(57) ABSTRACT

A plating film is provided with enough hardness before anodic oxidation, which is hard to be damaged during handling, and also the production method of the plating film. This problem can be solved by an aluminum plating film with aluminum concentration of 98 wt. % or lower, and with a Vickers hardness of 250 or higher. The hardness is increased by containing oxygen, carbon, sulfur, and a halogen element as impurities. The impurity concentration is controlled by adjusting the current density, the plating temperature, or the plating bath composition.

6 Claims, 20 Drawing Sheets

ALUMINUM PLATED FILM AND METALLIC MEMBER

CROSS-REFERENCE TO RELATED APPLICATIONS

The present application is a divisional of U.S. patent application Ser. No. 12/308,684 filed May 20, 2009, now U.S. Pat. No. 8,262,893, issued on Sep. 11, 2012, which is a 35 U.S.C. 371 National Stage Entry of PCT/JP2007/062686, filed Jun. 25, 2007, which claims priority from Japanese Patent Application Nos. 2006-180289 filed Jun. 29, 2006, and 2007-102353 filed Apr. 10, 2007, the contents of which are herein incorporated by reference in their entirety.

BACKGROUND OF THE INVENTION

1. Field of the Invention

This invention relates to a hard aluminum plating film produced by an aluminum electroplating method, and a production method for the same.

2. Description of the Related Art

An aluminum electroplating method is known as one of the plating methods which can respond to a rise of environmental awareness, since heavy metals which affect the environment and a human body are included in neither a plating bath nor a plating film. The surface of the coated layer made of aluminum can be excellent in abrasion resistance, corrosion resistance, coloring, etc. by anodizing it, therefore, many studies are done for practical use. As a method of forming the aluminum plating film, a hot-dip method is generally known. In an aluminum hot-dip coating method, aluminum is molten at high temperature such as around 700° C., and a sample is immersed in it. Therefore, the coating can be made easily, however, on the other hand, it is not easy to control the film thickness, and pinholes or voids can easily occur. Furthermore, the melting point of a sample made of magnesium is 648.8° C. for example, therefore, in the aluminum melt, since the sample is molten the coating cannot be made.

On the other hand, film thickness can be controlled by adjusting the quantity of electric charge in the aluminum electroplating method, and the aluminum can be plated at a low temperature of 200° C. or lower. The standard electrode potential in aluminum plating is −1.71V, and is baser than the electrode potential in hydrogen generation, such that plating aluminum from solution is very difficult. Therefore, aluminum electroplating can be done using a nonaqueous solvent or fused salt.

As the organic nonaqueous solvent, a plating bath using toluene solvent was reported in 1956 by Ziegler and Lehmkuhl, and is widely used known as the Sigal Process (tradename). This plating bath is composed mainly of triethyl aluminum, sodium fluoride, and toluene, and triethyl aluminum used as solute has strong water-reactivity and strong spontaneous combustibility, therefore, the plating machine must be explosion proof. Also, cleaning process after the plating, or wasting the cleaning solution, is not easy, either, and study on these processes is needed.

As one of other nonaqueous solvents for plating baths, plating bath using aluminum chloride, lithium hydride aluminum, and diethylether (Hydride type plating bath) was reported in 1952 by Brenner et. al, and it is known well. Also, a plating bath using tetrahydrofuran solvent in which liquid stability has been improved, is reported and widely used. However, lithium hydride aluminum or lithium hydride used as an additive, is very active chemically, and is not used currently because of potential for explosions.

On the other hand, plating methods for various alloy systems using fused salt are reported, however, no plating method which can be used practically is found, except for a plating method for manganese-aluminum alloy. The plating bath used here is mainly composed of aluminum chloride, sodium chloride, and potassium chloride, and a small amount of manganese chlorides are added. In this fused salt plating method, because reagent containing chlorides mainly is used, the plating machine utilized corrodes after using it for a long time. There is also a report that after melting alkylpyridinium halide, quaternary ammonium halide, alkylimidazolium halide, onium halide, and aluminum halide at the temperature of around 100° C., and plating electrically, plating film is obtained (patent document 1: JP, 2755111,B). However, the reagents are very expensive, and the initial making up process of the bath becomes complicated, therefore, it is unsuitable for practical use.

Here, in patent documents 2 (JP,2004-76031,A (a claim, FIG. 1, FIG. 2)) and 3 (JP,2006-161154,A), it is shown that aluminum can be electroplated by a plating bath using dialkylsulfone such as dimethylsulfone. According to patent documents 2 and 3, after mixing the anhydrous salt of the metal which is made to be the plating film in dimethylsulfone, heating this mixture up to about 110° C., melting of the metal anhydrous salts, finally, the plating bath is made up. In the plating bath, the metal complex ion in which dimethylsulfone is coordinated, is generated and after electroplating, the metal contained in the metal complex ion is reduced and precipitated on the surface of a cathode (base material), and the plating film is formed. Since water does not exist in this plating bath, electrolysis of water does not occur, and plating film made of a metal with low reduction potential can be formed, and since potential for explosion of dimethylsulfone during contact with air is low, it is supposed that it can be used very safely. Currently, there is no restriction for environment on the dimethylsulfone currently used for this plating bath, toxicity like other organic solvents is not reported, either. The melting point of dimethylsulfone is 102-109° C., therefore, in fused salt plating methods, there is an advantage that process temperature can be made comparatively low.

However, the aluminum electroplating film obtained by the above-mentioned conventional technology is soft, before anodic oxidation, therefore, uses of the film were restricted, because the film is easily damaged during the handling of the sample. It was shown that functions caused by characteristics of inactive particulates are given to the plating film, by dispersing the inactive particulates uniformly in the plating film in the plating method of patent document 1, however, it is not so easy to disperse these particulates uniformly.

Therefore, the purpose of this invention is, to provide a plating film with enough hardness before anodic oxidation, which is hard to be damaged during handling, and also to provide the production method of the plating film.

SUMMARY OF THE INVENTION

The above-mentioned problems can be solved by making an aluminum plating film contain some impurities uniformly.

Therefore, an aspect in accordance with the 1st invention provides, an aluminum plating film with an aluminum concentration of 98 wt. % or lower, and with a Vickers hardness of 250 or higher, or an aluminum plating film with an aluminum concentration of 97 wt. % or lower, and with a Vickers hardness of 300 or higher preferably.

By providing the aluminum plating film of the first invention on a base material, a metallic member covered with the aluminum film with hardness of 300 Hv or higher can be obtained.

An aspect in accordance with the 2nd invention provides, a production method of an aluminum plating film comprising:

immersing a base material in a plating bath in which aluminum halide is dissolved in alkylsulfone, and sending current with current density of 0.25~6 A/dm$^2$ to said base material.

An aspect in accordance with the 3rd invention provides,

A production method of an aluminum plating film comprising:

immersing a base material in a plating bath in which aluminum halide is dissolved in alkylsulfone, keeping temperature of the bath at 60~140° C., and sending current to said base material.

An aspect in accordance with the 4th invention provides, a production method of an aluminum plating film using barrel plating comprising:

immersing a barrel in which base material is contained in a plating bath in which aluminum halide is dissolved in alkylsulfone, and rotating said barrel in said bath, while sending current with current density of 0.25~6 A/dm$^2$ to said base material.

An aspect in accordance with the 5th invention provides, a production method of an aluminum plating film using barrel plating comprising:

immersing a barrel in which base material is contained in a plating bath in which aluminum halide is dissolved in alkylsulfone with temperature of 60~140° C., and rotating said barrel in said bath, while sending current to said base material.

As the aluminum halide used as an aluminum source, anhydrous salts, such as aluminum chloride or aluminum bromide, can be used. Dimethylsulfone, diethylsulfone, dipropylsulfone, etc. can be used as the alkylsulfone. As for aluminum concentration in the plating bath, 1.5-4.0 mol is preferred to 10 mol of alkylsulfone. 2.0-3.0 mol is preferred especially. If this aluminum concentration is lower than 1.5 mol, so called burnt deposit (side reaction product produced because of lack or excess of the complex ion of aluminum, most of that is black colored) is generated, and plating efficiency decreases. On the other hand, if this aluminum concentration exceeds 4.0 mol, defects, such as the burnt deposit or bare spot, will decrease, but electric resistance of the bath becomes high, and it becomes hot. As the process temperature, 60-140° C. is preferred. Hardness of the plating film depends on the contained impurities greatly, and it is thought that the impurities in the plating film in this invention are doped by the side reaction between the plating film and the plating bath. Therefore, if the temperature will be lower than 60° C., viscosity will become high and side reaction speed will decrease, and the amount of impurities doped to the inside of the plating film will decrease. Furthermore, the burnt deposit may be easily generated, because of the lack of supply of the ion. On the other hand, if it exceeds 140° C., the side reaction will be activated, but the structure of the complex formed of aluminum halide and alkylsulfone changes, and the film with poor adhesion is formed. Current density is preferred to be 0.25~6 A/dm$^2$, or 0.25~4 A/dm$^2$ more preferably. 1~4 A/dm$^2$ is preferred mostly. When the current density becomes lower than 0.25 A/dm$^2$, the side reaction becomes dominant and the plating film is hard to be generated. On the other hand, if exceeds 4 A/dm$^2$, the amount of doped impurities will decrease, and the burnt deposit of the film becomes remarkable because of the excess electron. If it exceeds 6 A/dm$^2$, the amount of the doped impurities will decrease further, and the film with enough hardness becomes hard to be obtained.

EFFECT OF THE INVENTION

As mentioned above, according to this invention, aluminum electroplating film with enough hardness before anodic oxidation, which is hard to be damaged during handling, can be obtained.

DETAILED DESCRIPTION OF THE PREFERRED EMBODIMENTS

Next, this invention is explained concretely by examples, although is not limited by these examples.

At first, the characteristics of the aluminum plating film of this invention are explained.

[Plating Apparatus]

Figure 1:
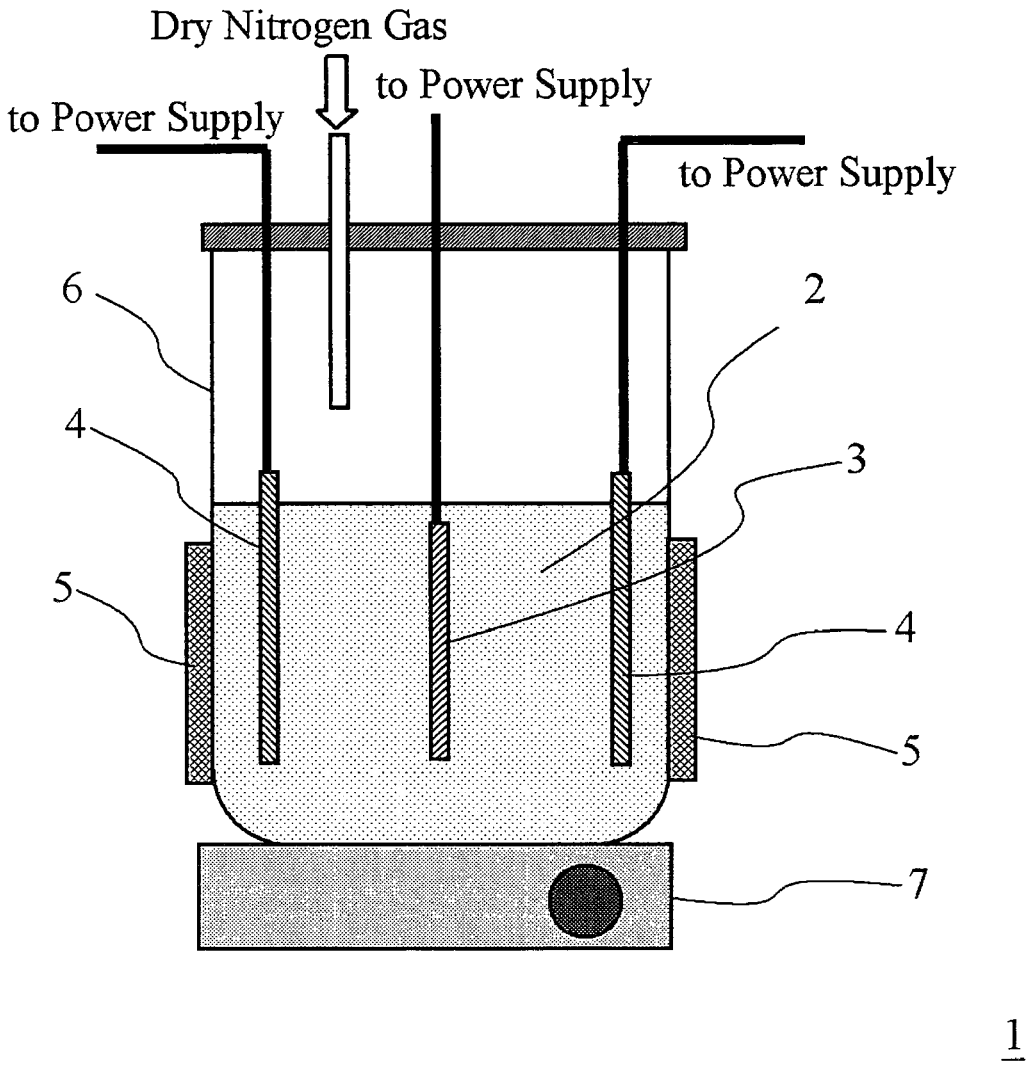
FIG. 1 shows a schematic diagram of an aluminum plating experimental apparatus.

The outline of the plating apparatus utilized is shown in FIG. 1. In this plating machine 1, base material 3 which is used as a cathode, and aluminum plate 4 which is used as an anode are immersed in plating bath 2, and current is sent between them. The temperature of plating bath 2 is controlled by heat source 5. Since strong hygroscopic property is seen in $AlCl_3$ contained in the plating bath, the experiment was done so that the plating bath did not take in moisture in the atmosphere. Separable flask 6 with a cap (capacity: 2 l.) was used, flowing dry nitrogen of 5 L/min for airtightness during the plating. Heating was done by the silicon rubber heater in heat source 5, and temperature was controlled by the voltage regulator and the thermoregulator. Heating functions are given to stirrer 7. An aluminum plate (70 mm×70 mm×2 mmt) with purity 99.99% was used for anode plate 4. A copper plate (70 mm×70 mm×0.2 mmt) was used as cathode 3, also as a base material.

[Initial Making Up of Plating Bath]

Figure 2:
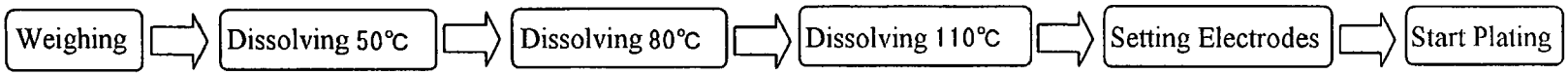
FIG. 2 shows the initial making-up process of aluminum plating bath.

Aluminum electroplating bath was made using dimethylsulfone ($CH_3SO_2CH_3$:$DMSO_2$) as the solvent, and anhydrous aluminum chloride (III) ($AlCl_3$) as the solute. An initial making-up process of the bath is shown in FIG. 2. These were weighed so that the molar ratio of $DMSO_2$ and $AlCl_3$ might be set to 5:1, ($DMSO_2$: 2300 g, $AlCl_3$: 650 g), and were mixed in a beaker, and preheating of 2 hours was performed at 50° C. or 80° C. Then, these were heated up to 110° C., which is slightly higher than the melting point (109° C.) of $DMSO_2$, and the reagent were completely dissolved. As shown in FIG. 1, cathode 3 and anode 4 were installed, and the plating process was started, and after keeping them for 1 hour the temperature of the electrodes became stable.

[Plating Conditions]

Plating temperature: 100~130° C.

Current density: 0.25~14 A/dm$^2$

[Hardness Measurement]

Hardness was measured as a Vickers hardness. The plating film with thickness of 50 micrometers or thicker was formed on a smooth substrate, and it was used as the sample. The used machine is a micro hardness tester (form: MVK-G2, made by the Akashi Seisakusho, Japan). In addition, in a Vickers hardness measurement of a plating film, when the sample is thin, the measurement will be influenced by the hardness of the substrate, however, it is said that the measured value becomes reliable if the thickness of the plating film is 1.5 times or thicker of the diameter of the indentation by Vickers indent (ISO06507-1).

[Measurement of Crystal Orientation]

As samples for measurement of crystal orientation, copper substrate on which plating films were formed with various conditions, were used. The degree of crystal orientation was estimated using ratio of intensity of each reflection peak to that of (111) peak and full width at half maximum of the peak. In addition, the machine used for the measurement is X-ray diffractometer RINT1500, made by Rigaku Denki, Japan. Moreover, in order to suppress the influence by excitation of the substrate, Co Kα line was used as X-ray source.

[Measurement of Crystal Grain Diameter]

The average crystal grain diameter of the plating film was measured, by number of the crystal grain boundaries intersecting a segment of unit length.

[Measurement of Impurity Concentration]

In order to measure the impurity concentration in the plating films, EDX analysis by FE-SEM (type: S-2300) and analysis by EPMA were done.

Moreover, in order to investigate variation of impurities qualitatively in the plating films, analysis by GD-OES was done.

Figure 3:
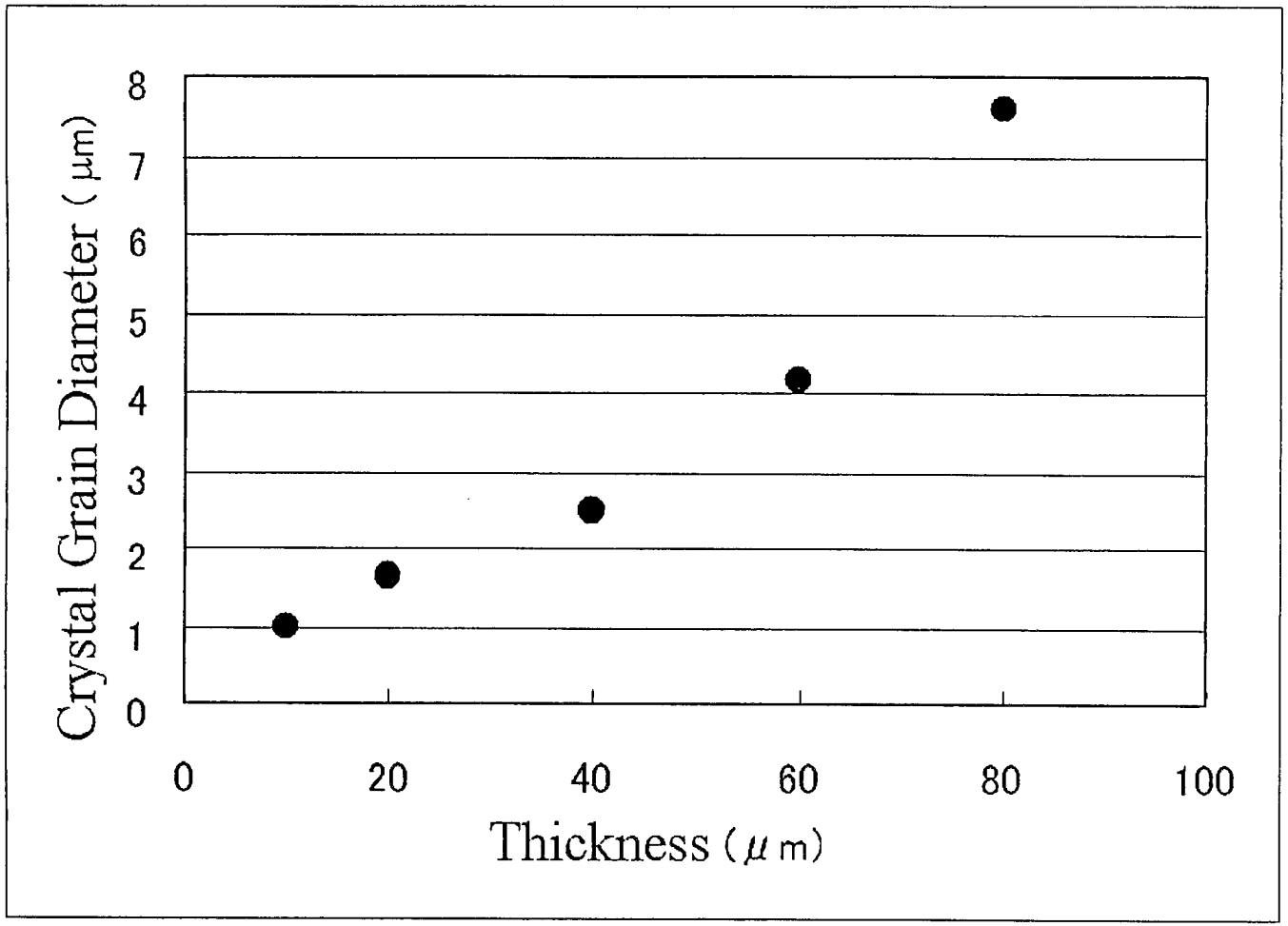
FIG. 3 shows the relation between the crystal grain diameter on the surface and thickness of plating film.
Figure 4:
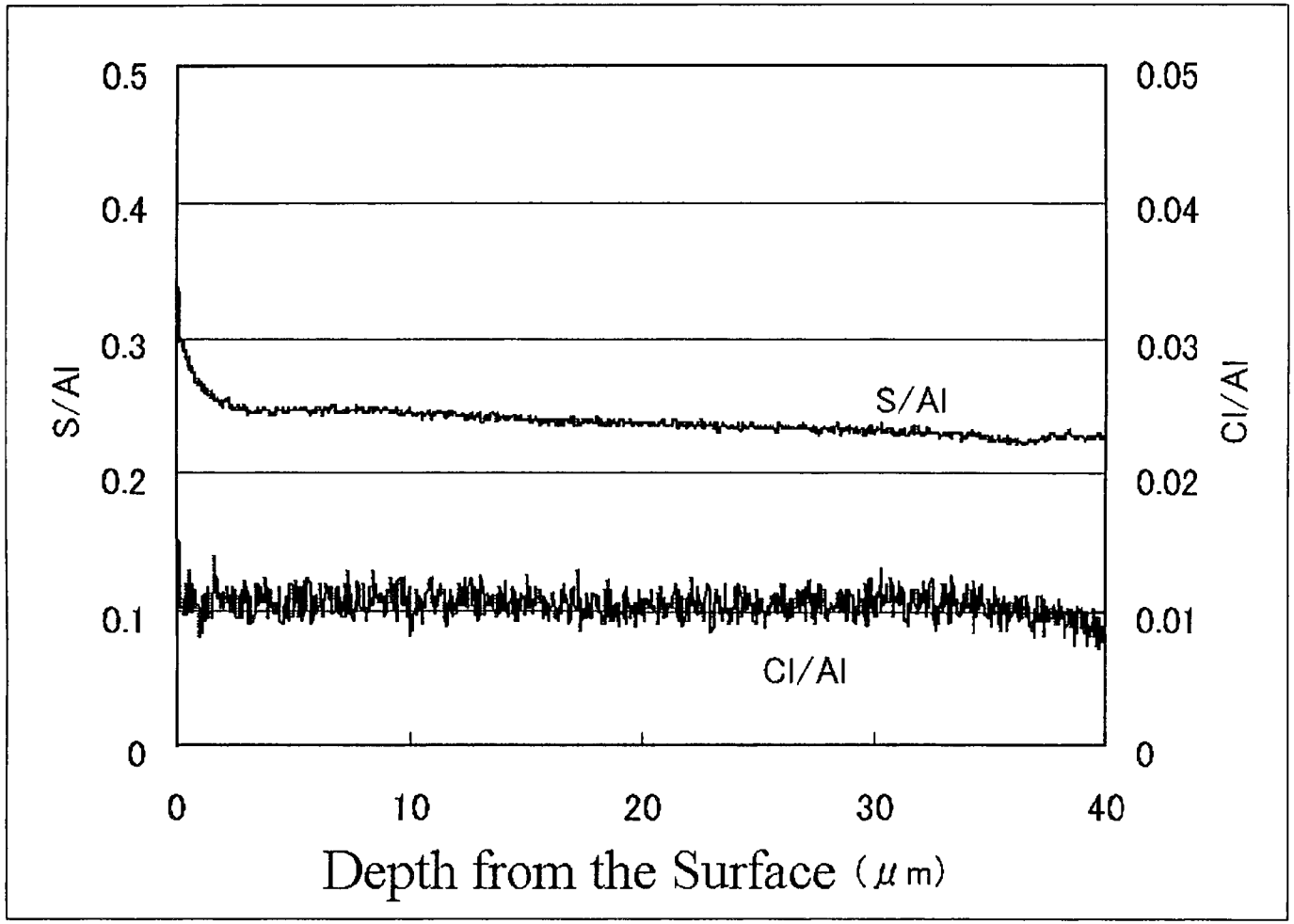
FIG. 4 shows the GD-OES result of the aluminum plating film.

The main impurity elements contained in the plating films were chlorine, sulfur, carbon, and oxygen by results from the analysis. When current density is decreased, the amount of impurities in the plating films is increased, and the crystal grain becomes finer. Also when stirring speed became slow, the impurity concentration was decreased slightly. The measured results of crystal grain diameter and impurity concentration dependence on plating time (corresponding to the film thickness), using SEM and GD-OES (glow discharge emission spectrometry, Glow Discharge Optical Emission Spectrometry) are shown in FIGS. 3 and 4. Here, glow discharge means a phenomenon arising when the voltage of hundreds of V is given between electrodes under argon gas atmosphere with pressure of hundreds of Pa. Then, the cathode (sample) is sputtered by argon ion, and sputtered atoms are excited by the electron generated by the discharge, and light is emitted. The concentration profile along depth direction can be obtained by sputtering and measuring light intensity simultaneously. From FIG. 3, when plating film becomes thicker, the crystal grain diameter changes greatly. It is shown that crystal grain diameter varies along the thickness direction of the film, and it is smaller at the substrate side and is larger at the surface side. On the other hand, in the result of composition analysis along the depth direction by GD-OES shown in FIG. 4, intensity ratio of the emitted light by impurities (S, Cl) to that by aluminum does not vary. Therefore, it is thought that impurities are contained not in grain boundaries, but in grains uniformly.

Figure 5:
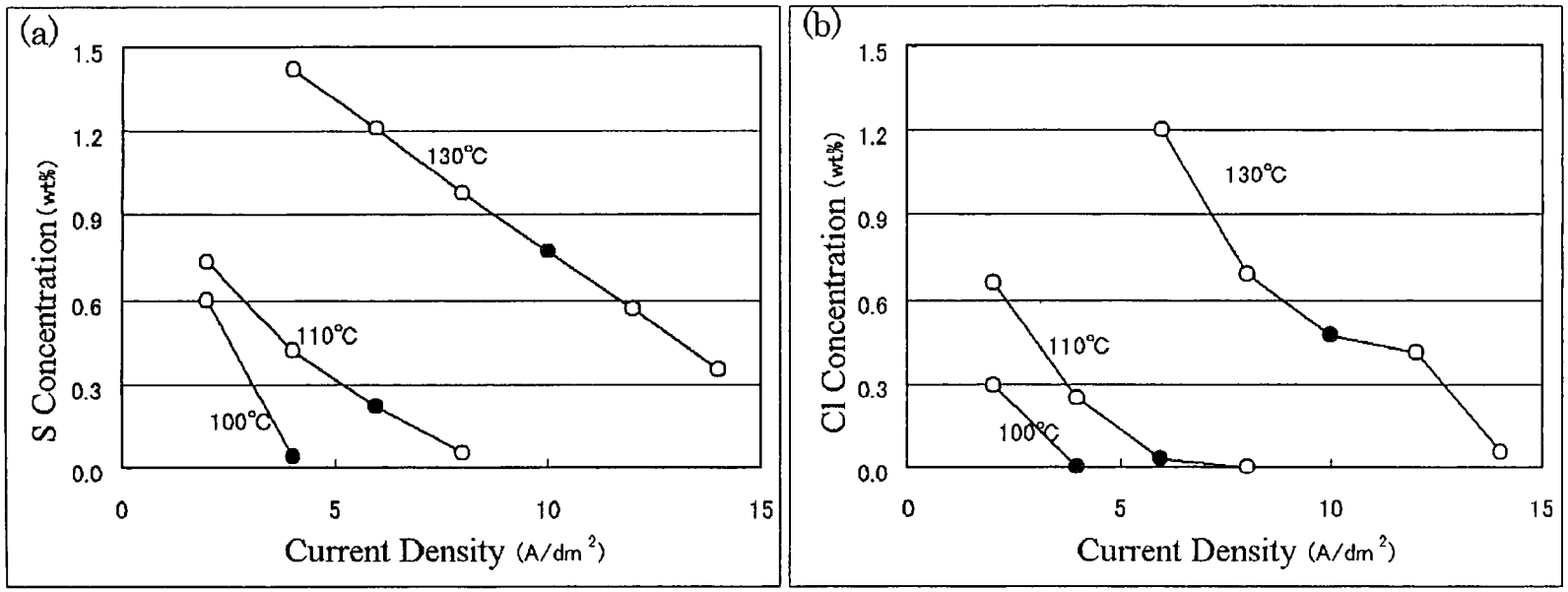
FIG. 5 shows the relation between current density, plating temperature, and impurity concentration.
Figure 6:
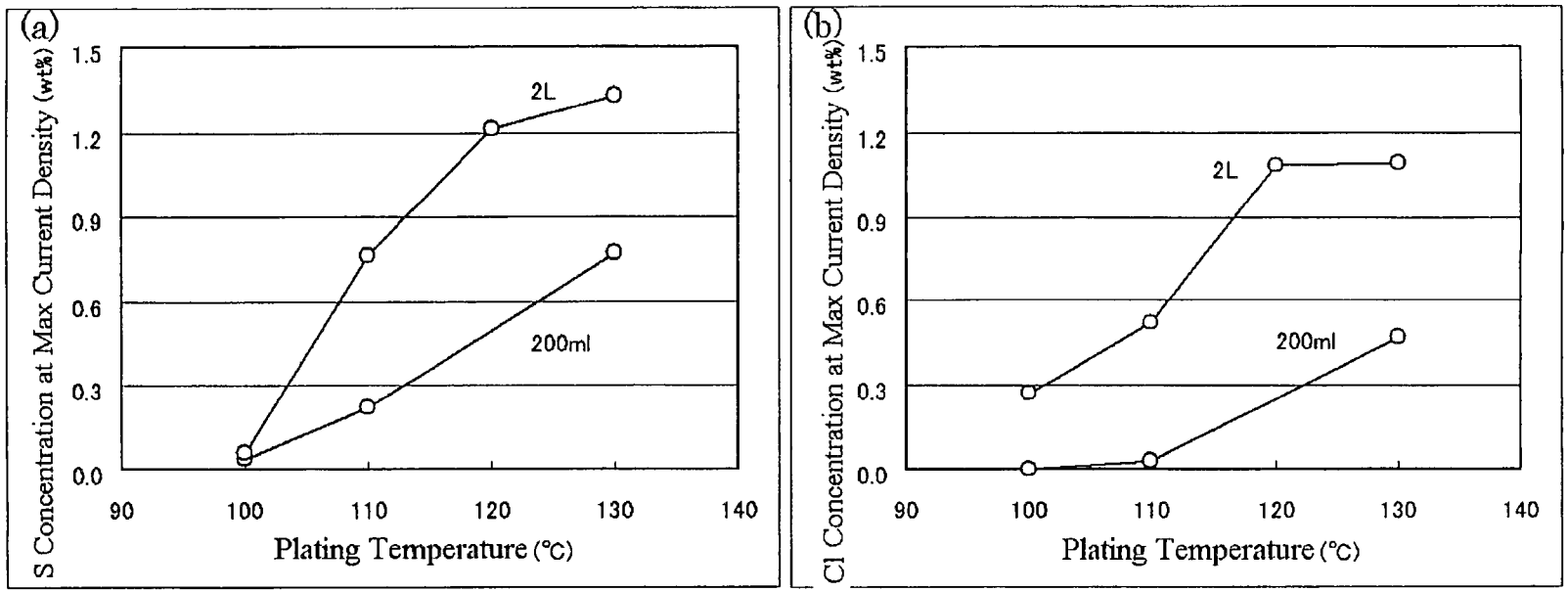
FIG. 6 shows the relation between the impurity concentration at maximum current density, and temperature.

Because rise in the current density causes generation of the burnt deposit (JIS-H 0400-8011), formation of the plating film with high purity is limited. FIG. 5 shows a impurity concentration dependence on temperature and current density, when stirring speed is 600 rpm using a 200 ml beaker. Here, impurity concentration was measured at the center of the sample, excepting the edge of the sample where the burnt deposit is found. When the plating temperature is constant, impurity concentration becomes lower as the current density becomes higher. On the other hand, if the temperature becomes low, contour lines of the temperature in the figure is shifted to a side with low impurity concentration. The current density limits (defined as maximum current density) with no generation of the burnt deposit at each temperature, are shown by •. The impurity concentration dependence on the temperature at the maximum current density is shown in FIG. 6. In the figure, results using samples in which similar measurements were done at stirring speed of 800 rpm in 2 L beaker, are also shown together. It is shown that the plating film purity becomes higher as the temperature is lower, using any machines. Also it is found that impurity concentration became high, as the volume of the plating bath became large. Because, since the flow in the bath by the stirring becomes slower as the volume of the plating bath becomes larger, plating reaction may be hard to arise and side reaction may arise easily. Therefore, it is preferred to make the volume of the plating bath larger than 2 L (2000 ml), to obtain the aluminum plating film with enough hardness. The relations of each conditions, impurities, and crystal grain diameter were summarized in Table 1.

TABLE 1

The Relationships between the Plating Parameters and Impurity Concentration, Crystal Grain Diameter.

| | Impurity Concentration | Crystal Grain Diameter |
|---|---|---|
| Fall of Current Density | Increase | Fine |
| Rise of Plating Temperature | Increase | Fine |
| Rise of Stirring Speed | Increase | Fine |
| Decrease of Plated Thickness | Not Changed | Fine |

Figure 7:
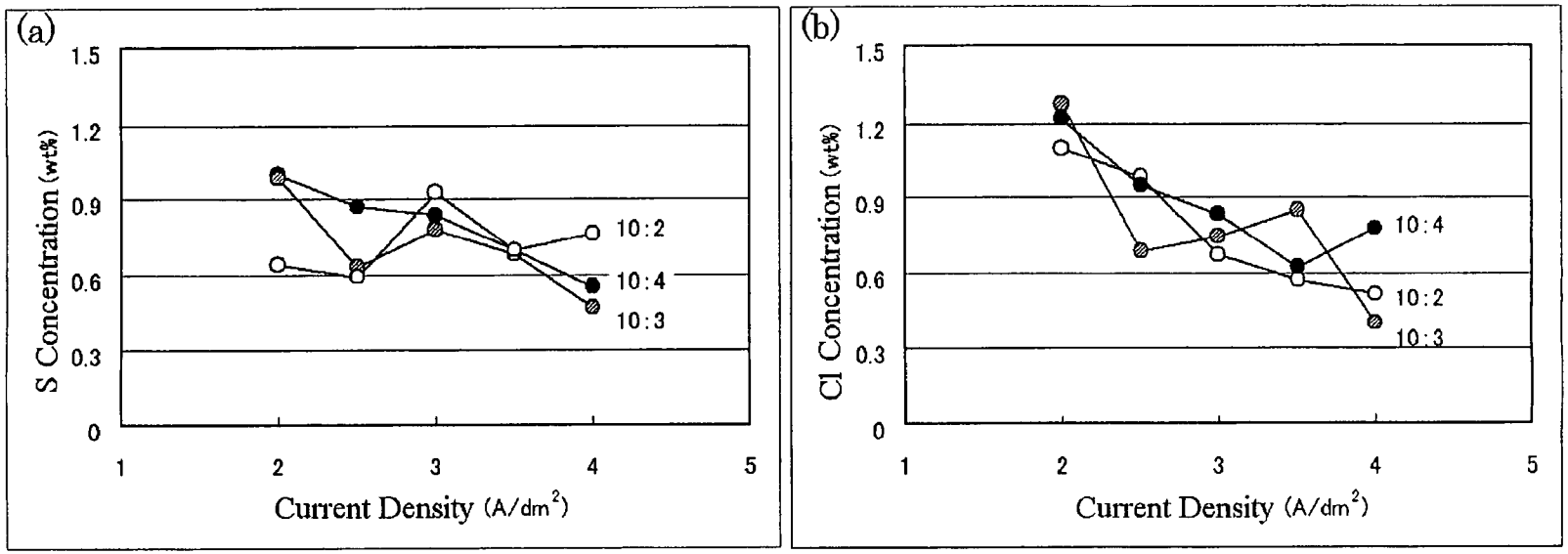
FIG. 7 shows the relation between plating bath composition, current density, and impurity concentration.

Here, plating bath composition was set 16.7 mol % of aluminum chloride. Because of the characteristics of the plating bath, its coagulating point is hard to be measured precisely, although this bath is solidified at about 90° C. When aluminum chloride concentration is made high to 28.6 mol %, the coagulating point will fall, and the plating can be done even at 60° C. If the concentration is made higher further, the coagulating point will rise again and also the coagulating point will fall again near 50 mol %. FIG. 7 shows the measured impurity dependence on the current density while the ratio of dimethylsulfone to aluminum chloride was varied, however, no great influence on the impurity concentration in the plating film is seen by varying the plating bath composition.

Figure 8:
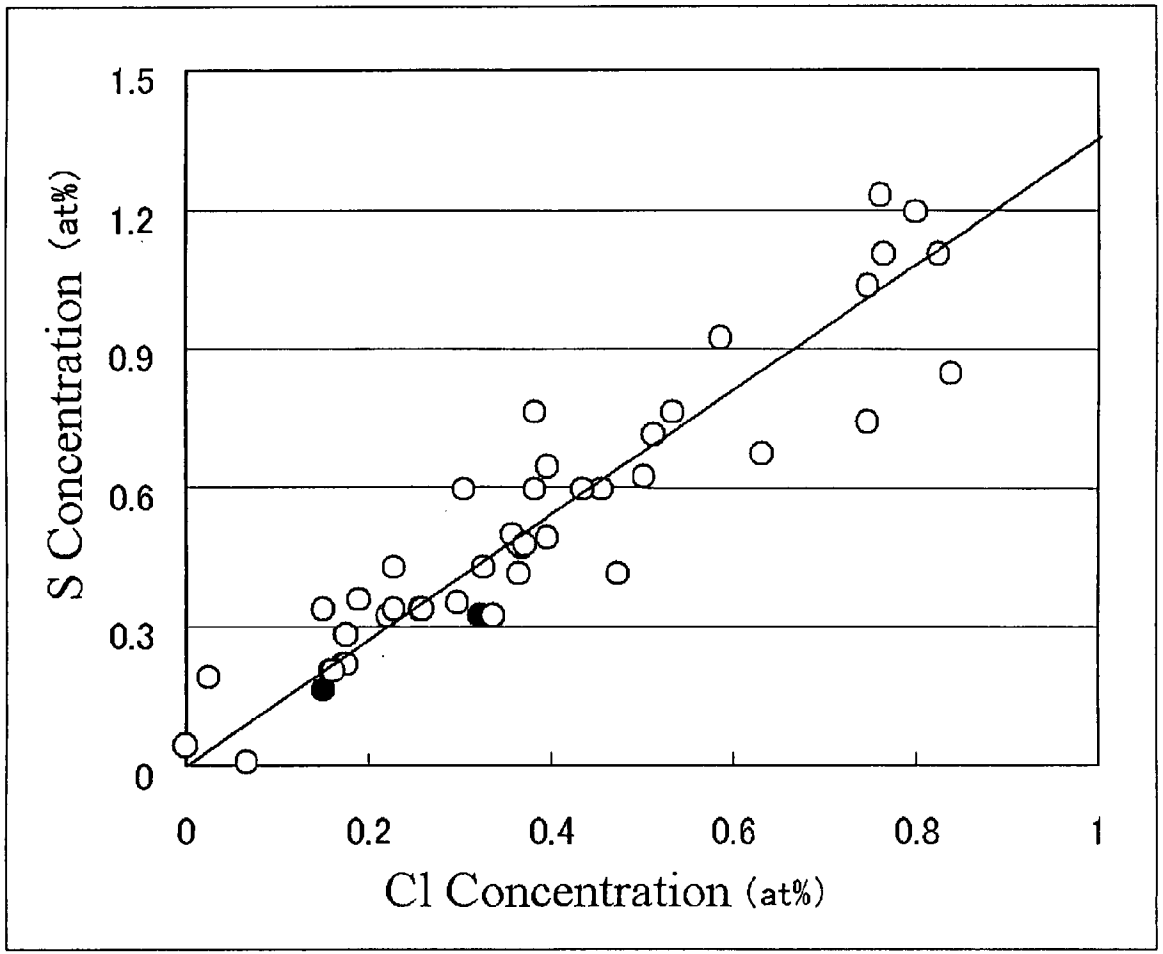
FIG. 8 shows a ratio of chlorine to sulfur in the plating film.

FIG. 7 shows that plating film composition does not depend on the bath concentration, however, it is necessary to take into consideration the variation in the plating film composition depending on the initial making-up process of the bath. In FIG. 5, impurity concentration as for sulfur and chlorine depended on the current density greatly, however the ratio of sulfur to chlorine was constant regardless of film thickness in FIG. 4. Then, the relation between measured compositions of sulfur and chlorine based on several kinds of samples is shown in FIG. 8. In the figure, the concentration ratio of sulfur to chlorine which are contained in the aluminum plating film is 1.35:1.00, and the sulfur concentration is within range of 1.35 times±30% of the chlorine concentration. There is almost no variation between samples. It turns out that these impurities may be compounds with fixed composition. Here, although results in which plating bath composition ratio varies were shown by •, these results did not vary from the ratio so much in FIG. 8.

Figure 9:
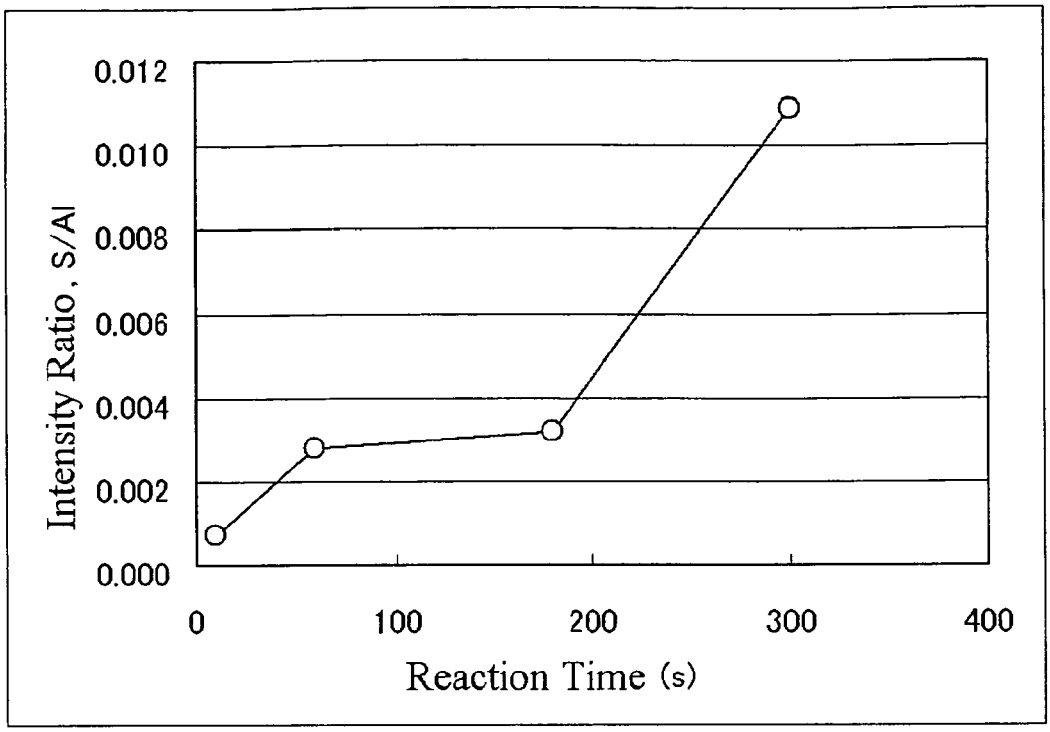
FIG. 9 shows the reaction between the aluminum plating film and the plating bath.
Figure 9:
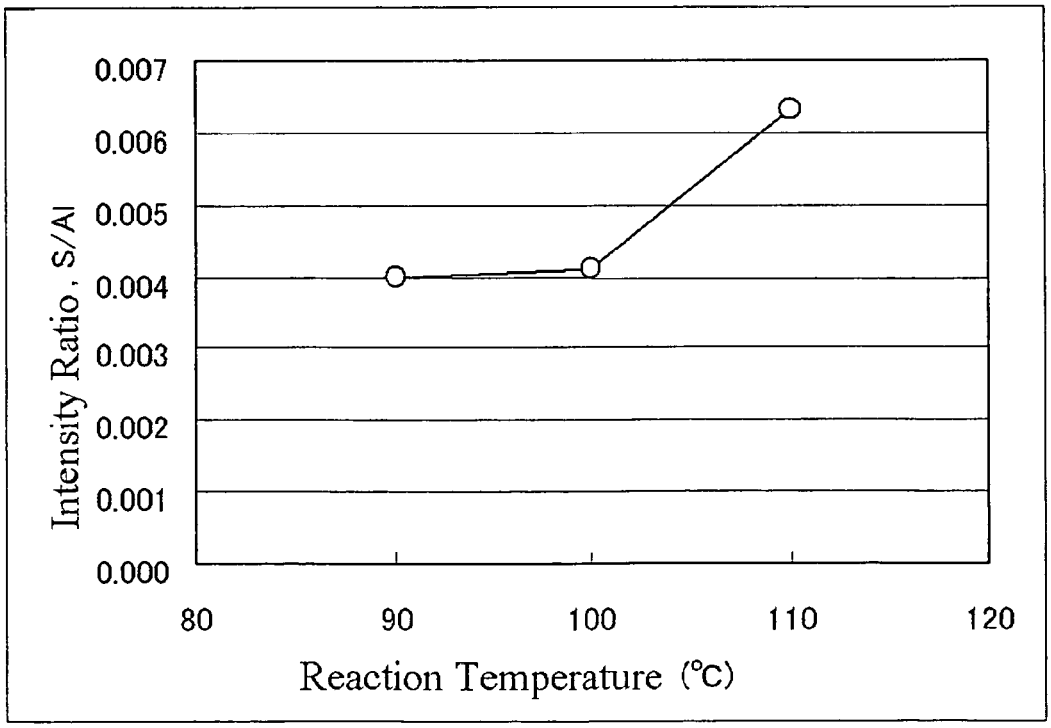

FIG. 9 shows the result of composition analysis on the aluminum plating film surface after being immersed for 10~300 s in the plating bath after the plating. Formed reaction layer can be removed easily by water cleanings therefore, after making plating bath and the plating film react, by doing aluminum plating further, the reaction layer was bound between these plating films and emitted light intensity by sulfur was measured by GD-OES here. FIG. 9 shows the result of the light intensity dependence of the reaction layer on reaction time and on reaction temperature. Here, the value of the light intensity of sulfur (S), normalized by that of Al, is shown. It is clear that the light intensity increases as reaction time becomes long, and the reaction between the aluminum plating film and the plating bath proceeds. Also, the light intensity increases, as the reaction temperature is high, and the reaction is activated. In the aluminum plating film of this invention, the amount of impurities increases as the current density is low (plating speed is slow), because it may be supposed that these side reactions proceed in addition to the plating reaction simultaneously, and impurities were taken into the plating film by these side reactions.

[Measurement of Crystal Orientation of the Plating Film]

Figure 10:
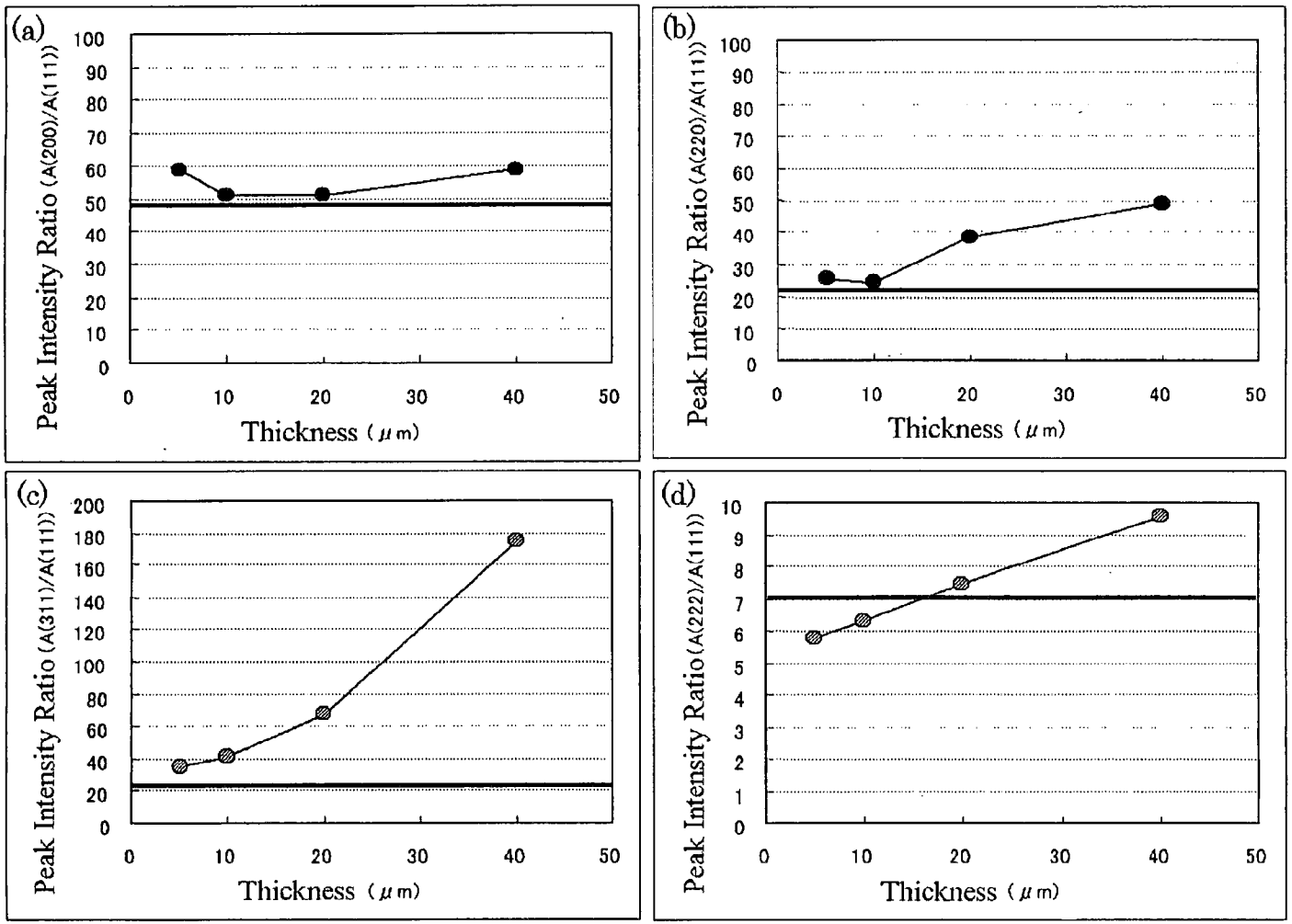
FIG. 10 shows the relation between crystal orientation of the plating film and the film thickness.
Figure 11:
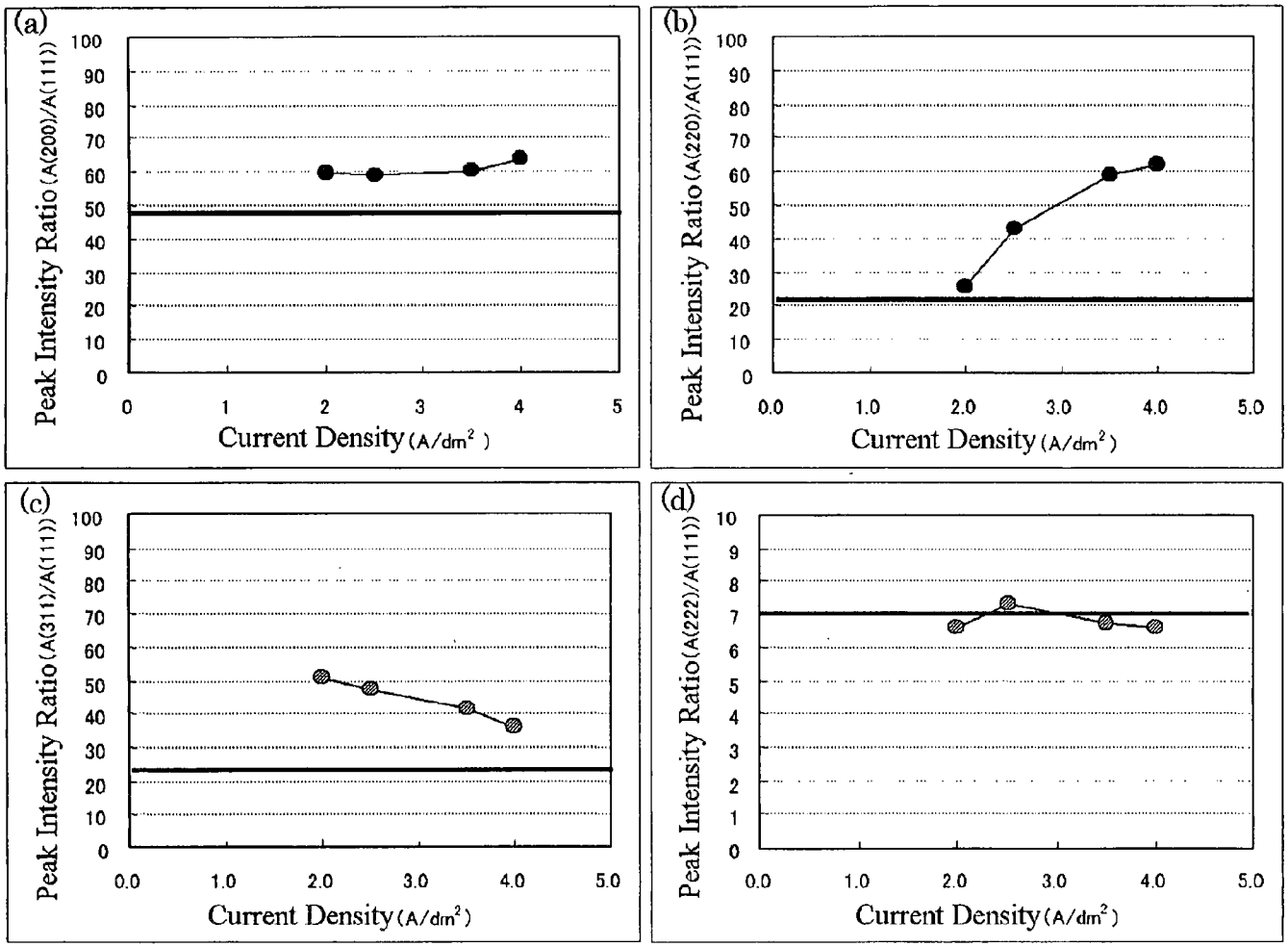
FIG. 11 shows the relation between the crystal orientation of the plating film and current density.

It turns out that the plating film formed by plating bath using dimethylsulfone as solvent has crystallinity, in order to investigate how the orientation varies with plating conditions etc., the peak intensity ratio in X-ray diffraction was measured. Dependence on the thickness is shown in FIG. 10, and that on the current density is shown in FIG. 11. The vertical axis corresponds to the intensity ratio normalized by (111) peak intensity. The solid line in the figure shows a peak intensity ratio in the standard sample of aluminum. From FIG. 10, when the film becomes thick, since all the peak intensity ratios are larger than that of the standard sample, it is supposed that (111) orientation becomes weak as the film becomes thick. Also, since (311) peak intensity ratio becomes remarkably large, it is supposed that (311) orientation becomes strong as the film becomes thick. Also in the dependence on the current density shown in FIG. 11, all the peaks have exceeded that of standard sample, and it turns out that (111) orientation is weak. Also, (220) orientation becomes strong as the current density is high, and (311) orientation may be weaker.

[Measurement of Adhesion Strength]

Figure 12:
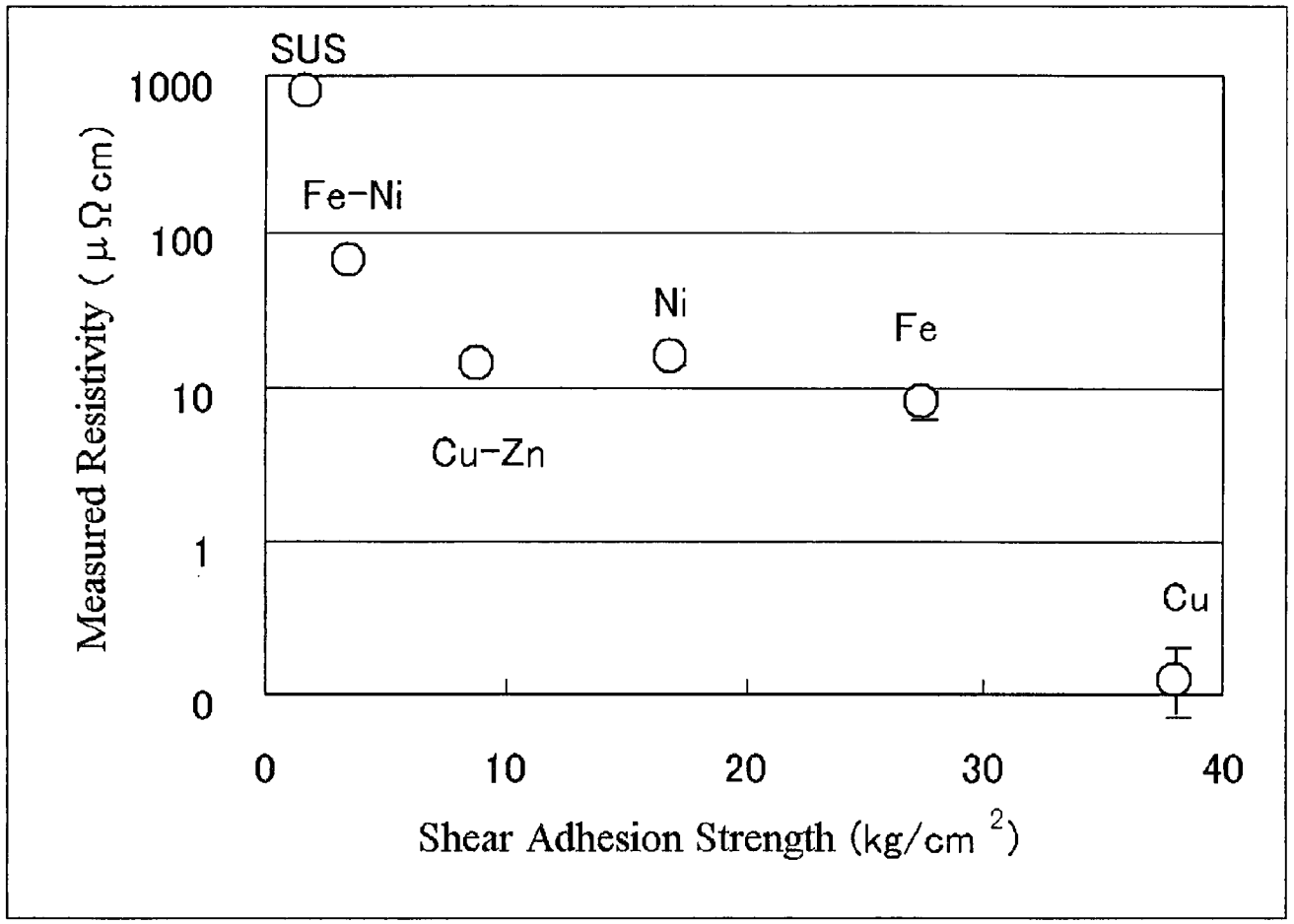
FIG. 12 shows the adhesion strength of the aluminum plating film on various base materials.

Values of the measured shear adhesion strength of the aluminum plating film on various substrates are shown in FIG. 12. The vertical axis corresponds to the electrical resistivity (measured value) of the substrate, and strong adhesion can be obtained by the substrate with low electrical resistivity. It is supposed that nuclei for the electroplating are hard to be formed on the substrate surface, because electrons are hard to move in the substrate with high electrical resistivity. The adhesion strength is getting weaker as SUS304, Fe-50 at % Ni alloy, Ni plates in order from the cross-cut test as shown in Table 2, and this tendency almost corresponds to the results of the samples. Therefore, a metal substrate with electrical resistivity of 50 μΩ·cm or lower is preferred, especially 1 μΩ·cm or lower more preferably.

TABLE 2

Results of Cross-Cut Test on Various Substrates (Ratio of not peeled area, unit: %)

| | |
|---|---|
| Cu | 100 |
| Fe | 100 |
| Cu—30 at % Zn | 100 |
| Ni | 88~100 |
| Fe—50 at % Ni | 68~100 |
| SUS304 | 0 |

[Effect of the Current Density (Impurities)]

Figure 13:
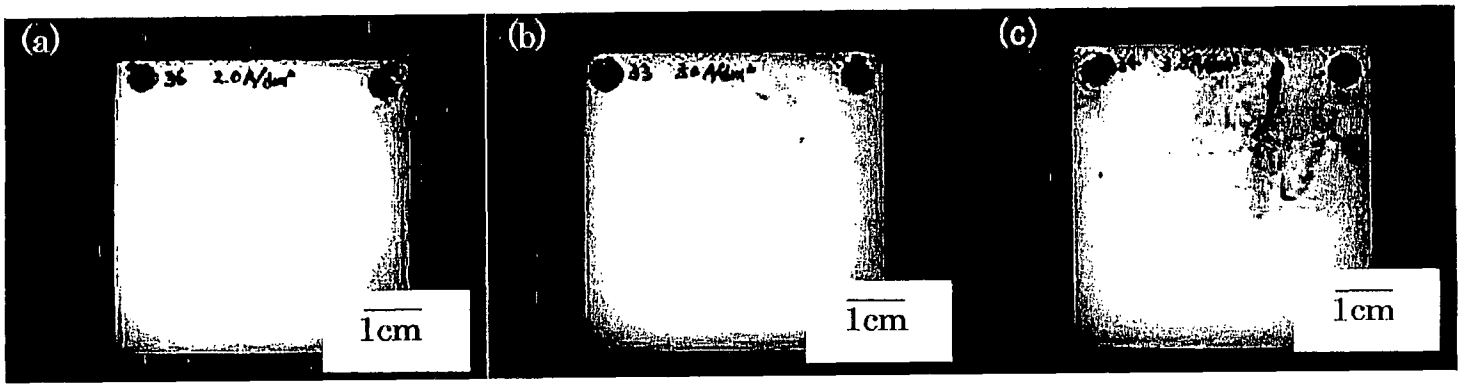
FIG. 13 shows the relation between current density and corrosion resistance.

In order to investigate the relation between impurity concentration in the plating film and corrosion resistance, corrosion resistance was investigated when the current density was (a) 2.0 A/dm$^2$, (b) 3.0 A/dm$^2$, (c) 4.0 A/dm$^2$ respectively. Film thickness was fixed to 40 μm. After aluminum was plated on the substrate, the surface was oxidized by hot water, and the salt spray test was done. The oxidation was done by immersing them 90° C. pure water for 1 hour. The result is shown in FIG. 13. Although no significant difference were seen up to 1500 hours after the start of the test, white rust was seen in each sample after 2000 hours passed. In comparison of the area with white rust, the area is largest in (c), and is larger as the current density is higher, when the purity of the film becomes higher. Therefore, it is concluded that existence of impurities improves the corrosion resistance of the plating film in the salt spray test. It is supposed that the corrosion resistance becomes higher as the current density is lower, since the crystal grain becomes finer and the film with fine structure is formed when the current density is lower.

[Measurement of Hardness]

Figure 14:
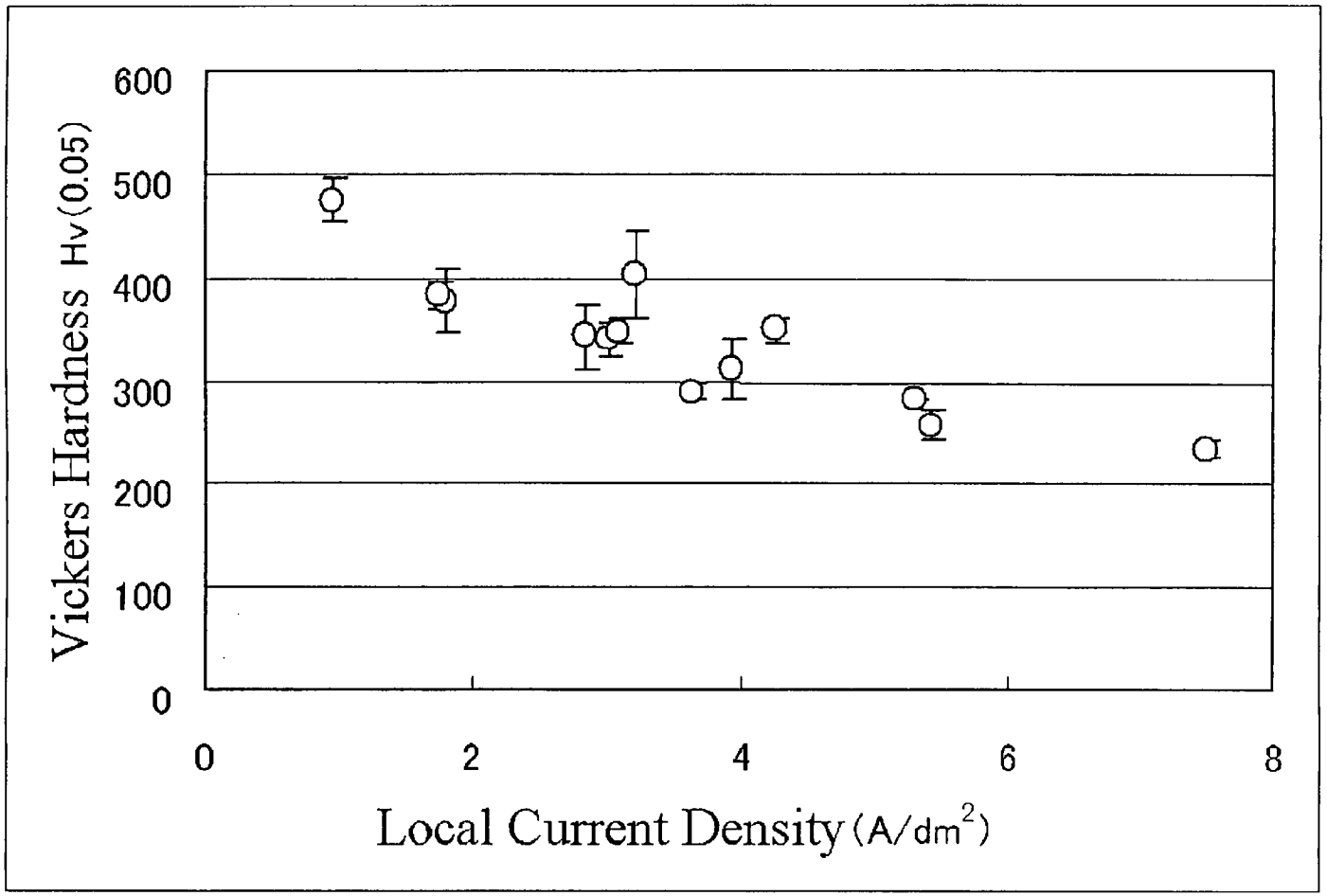
FIG. 14 shows the relation between current density and the hardness of the aluminum plating film.

Aluminum plating of this invention is electroplating process, and even when the substrate is plane, current density variation may arise within the plane. Therefore, in the hardness measurement using micro hardness tester, the measurement must be done corresponding to the position. Then, when the measurement of hardness was done, the film thickness was measured by cross section of the sample, and local current density was calculated at each measured point, the impurity concentration near the measured point was compared. The relation between local current density and the hardness is shown in FIG. 14. Here, current efficiency was supposed to be 100%. Hardness is decreased as the current density became large. Local current density of 4 (A/dm$^2$) or higher is required to obtain the film with hardness of 300 Hv or stronger, from FIG. 14. Local current density of 6 ($A/dm^2$) or higher is required to obtain the film with hardness of 250 Hv or stronger.

Figure 15:
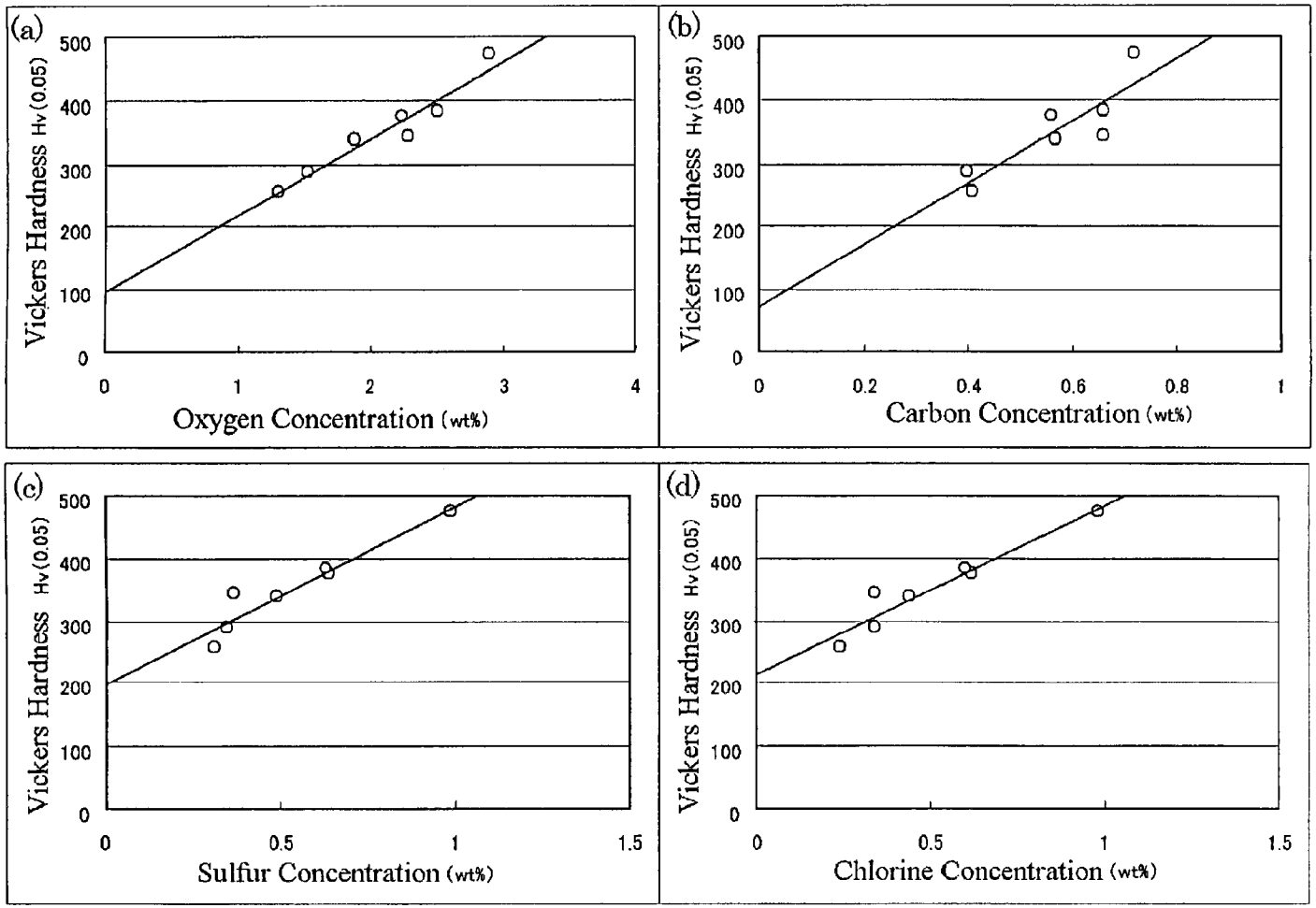
FIG. 15 shows the relation between impurity concentration and the hardness of the aluminum plating film.

Results of composition analysis near the measured point of hardness are shown in FIG. 15. The hardness becomes higher, as each impurities (oxygen, carbon, sulfur, chlorine) concentration increases, and it is thought that the film has hardened with these impurities. The hardness of the aluminum plating film can be controlled by adjusting the current density or the temperature of the plating bath, as shown in FIG. 5. And, from FIG. 15, impurity concentration of oxygen: 1.2 wt. % or higher, carbon: 0.35 wt. % or higher, sulfur: 0.2 wt. % or higher, chlorine: 0.15 wt. % or higher, is required to obtain the film with hardness of 250 Hv or higher, and impurity concentration of oxygen: 1.6 wt. % or higher, carbon: 0.45 wt. % or higher, sulfur: 0.35 wt. % or higher, chlorine: 0.3 wt. % or higher, is required to obtain the film with hardness of 300 Hv or higher.

Figure 16:
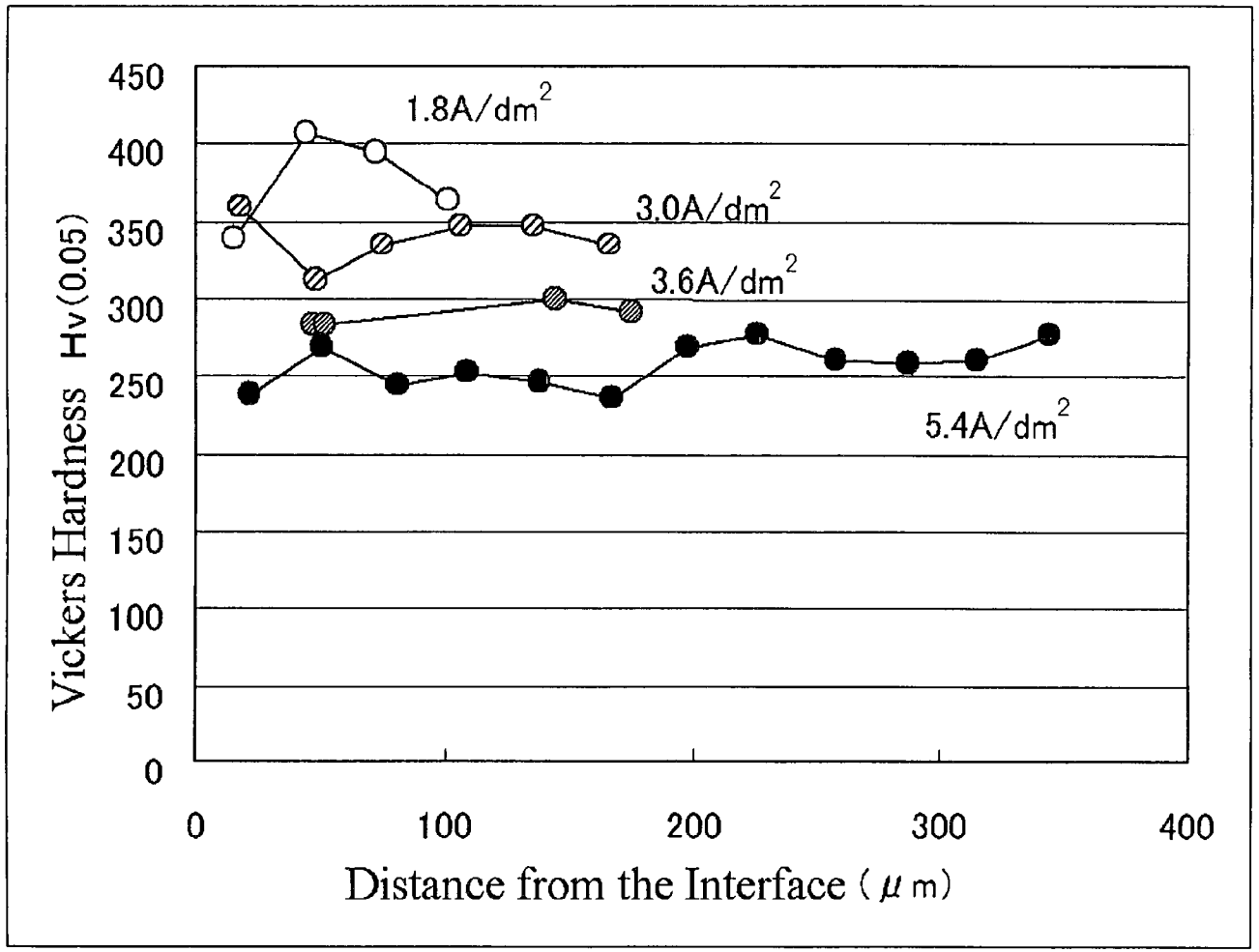
FIG. 16 shows the relation between thickness of the aluminum plating film, and the hardness.

The relation between the distance from the plating film/substrate interface and the hardness is shown in FIG. 16. As already shown, impurity concentration does not vary as the plating film becomes thick, but the crystal grain diameter becomes large, and (311) crystal orientation becomes strong, however, according to FIG. 16, the hardness of the film does not vary as the thickness varies. Therefore, it is concluded that variation of the orientation and the crystal grain diameter does not affect the hardness.

Figure 17:
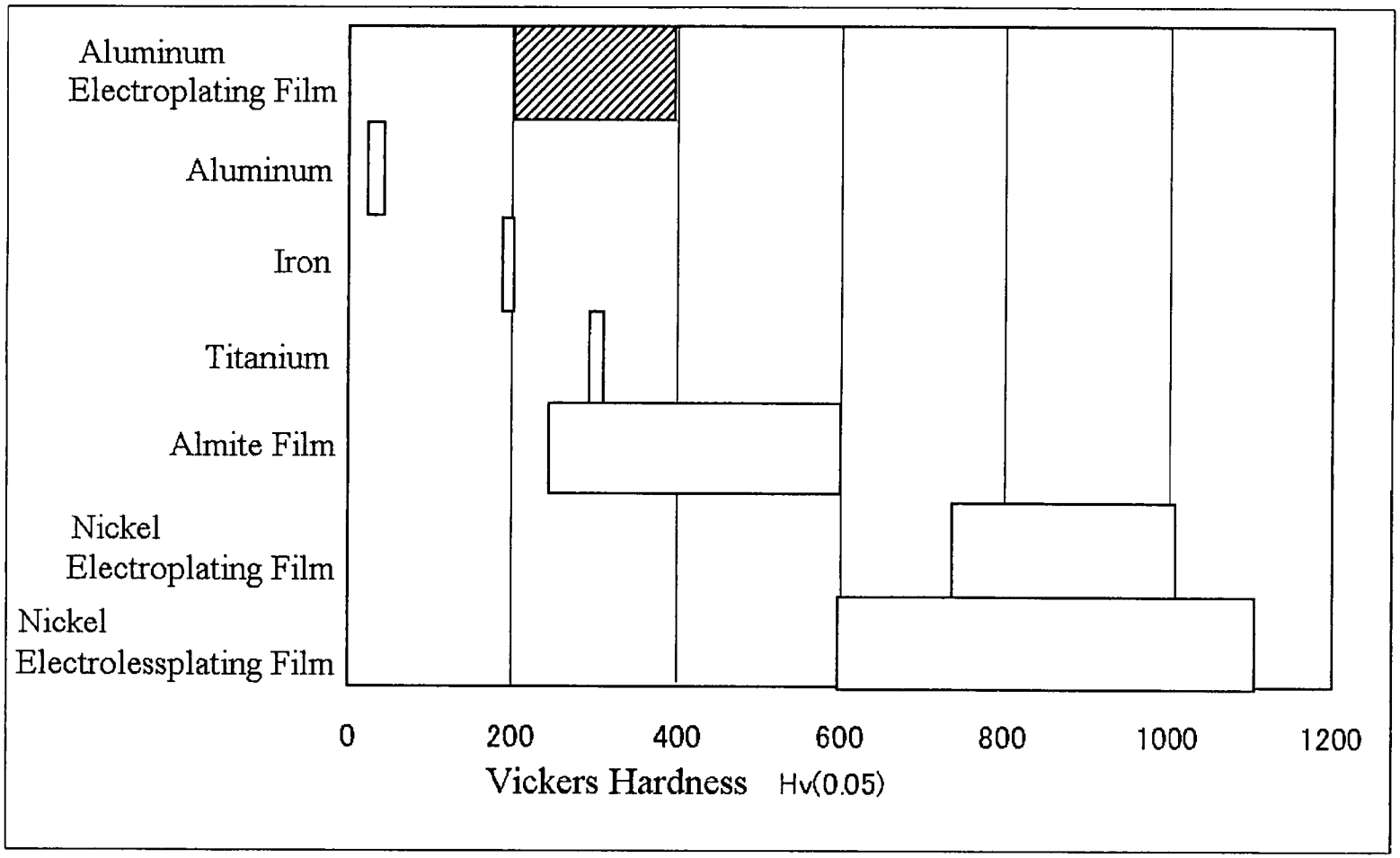
FIG. 17 shows the comparison of the hardness of the aluminum plating film of this invention, with various materials.

FIG. 17 shows the comparison of the hardness of the aluminum electroplating film of this invention with that of typical metal materials, here, the film with hardness of 250 Hv or higher was obtained by this invention, even in the aluminum electroplating film of this invention using the conditions by which the impurity concentration was low. The hardness of an alumite film (anodized film of aluminum) is 250-600 Hv. However, the plating film of this invention has already had equivalent hardness as the alumite film without the anodic oxidation.

Figure 18:
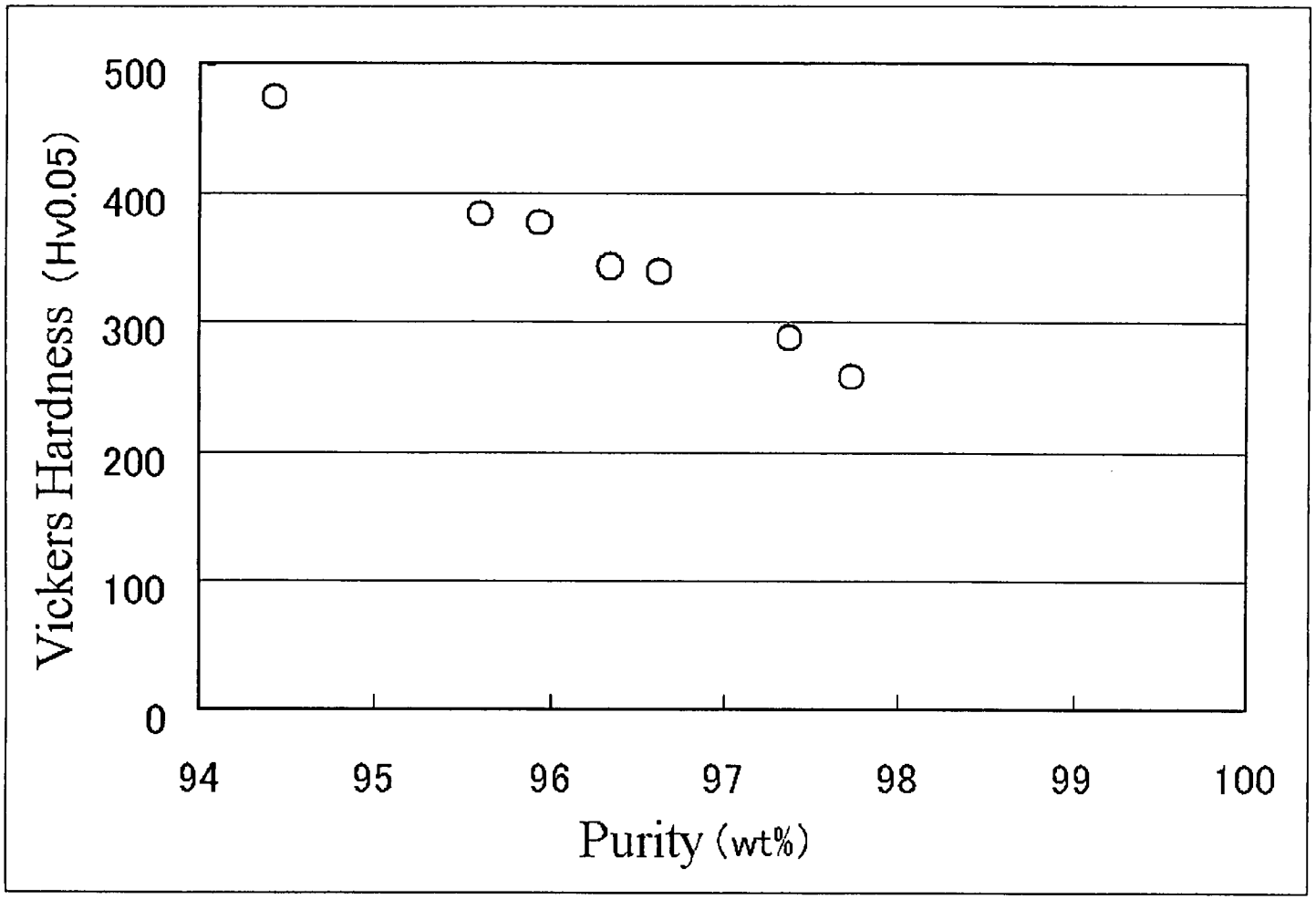
FIG. 18 shows the relation between purity of the aluminum plating film, and the hardness.

FIG. 18 shows the relation between the hardness and the purity of the film. When aluminum concentration (purity) is 98 wt. % or lower, Vickers hardness may be 250 HV or higher, and when the purity is 97 wt. % or lower, Vickers hardness may be 300 HV or higher. As described above, the impurity concentration is controlled by adjusting the current density or the temperature of the plating bath. By adjusting the plating conditions so that the impurity concentration is 2 wt. % or higher, 3 wt. % or higher more preferably, plating film with high hardness can be given, therefore, the aluminum plating film of this invention is effective also in the plating method with which high damage resistance is required, such as barrel plating method.

Figure 19:
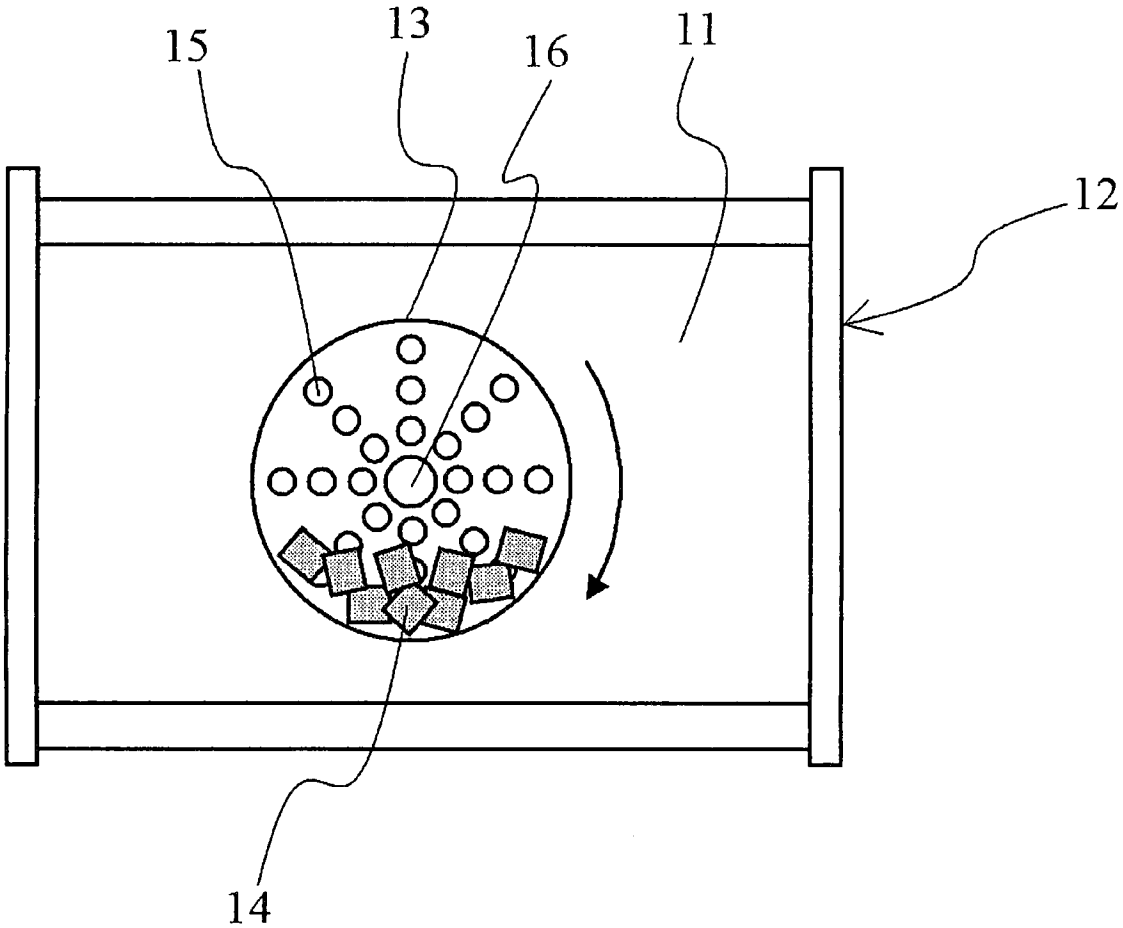
FIG. 19 shows a schematic diagram of a barrel plating apparatus.
Figure 20:
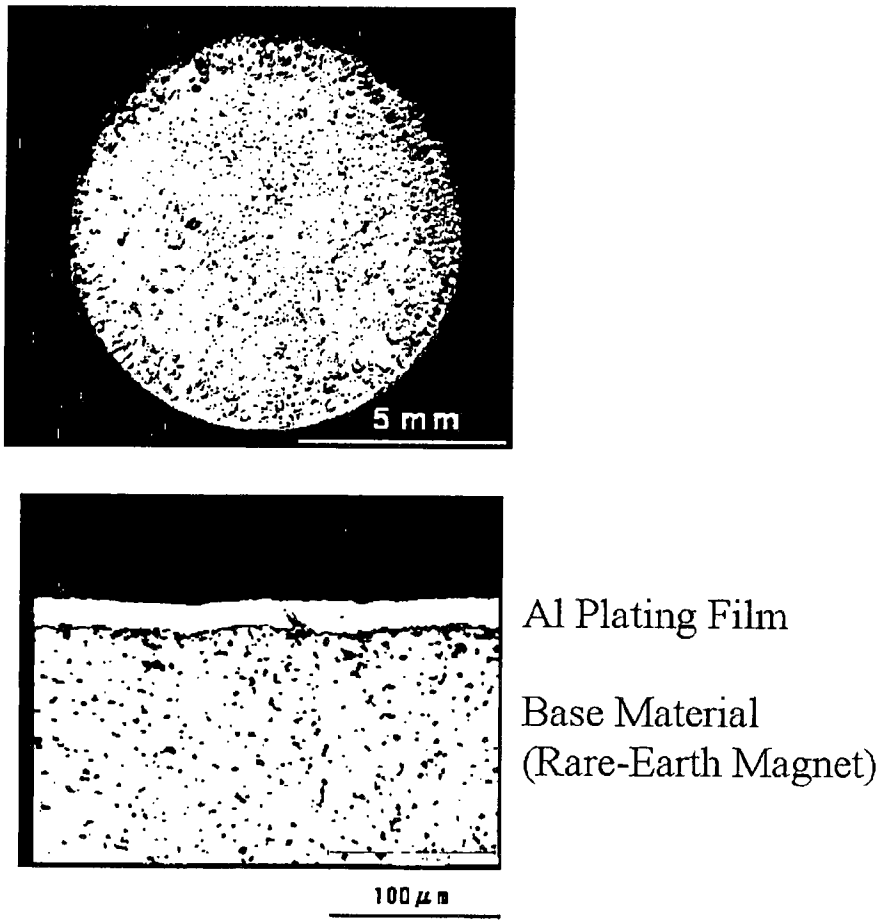
FIG. 20 shows the appearance and cross section photography of the plating film formed by barrel plating method.

It is known well that barrel plating method is used for coating to a lot of samples. However, the conventional aluminum plating film is soft, and plated samples collide with each other during rotation, and a crack may be generated easily on the film. Compared with it, the aluminum plating film of this invention is very hard, and can be applied to the barrel plating. The outline of the machine is shown in FIG. 19. Plating tank 12 is filled with plating bath 11, and barrel 13 is immersed in it. Many base materials 14 are contained in barrel 13 with holes 15 by which the bath is fed inside and with rotation axis 16. An anode (not shown) is immersed in the plating bath and a cathode (not shown) is formed in the barrel. Plating conditions are set up, and the barrel is rotated, sending current to the base materials 14. While the base materials 14 collide with each other, the aluminum plating film is formed. Without measures for preventing the crack such as making the base materials small or making the rotation speed slow, since the aluminum plating film of this invention is hard, the film is hard to be cracked. The appearance and photograph of the cross section of the plating film are shown in FIG. 20. This is the result of plating to the rare earth magnet of 9 mmϕ×5 mmt, and there are neither a crack nor a scratch by some parts etc., and the uniform plating film is obtained.

Above, examples using anhydrous aluminum chloride as the aluminum halide used for the aluminum source, are explained, although other halides, such as aluminum bromide, can be used similarly. In this case, similar results were obtained except that above-mentioned chlorine is replaced by bromine.

INDUSTRIAL APPLICABILITY

This invention can be applied to an aluminum electroplating film with high hardness just after the plating, which is hard to be scratched during handling, and to a production method for the same.

What is claimed:

1. An aluminum plating film formed by electroplating using a plating bath which is constituted by alkylsulfone as a solvent and an anhydrous aluminum trichloride (III) ($AlCl_3$) as a solute, with a micro-Vickers hardness of 250 or higher, wherein oxygen, carbon, sulfur and chlorine are contained as impurities, with an oxygen concentration of greater than or equal to 1.2 wt. % and less than or equal to 3.0 wt. %, a carbon concentration of greater than or equal to 0.35 wt. % and less than or equal to 0.8 wt. %, a sulfur concentration of greater than or equal to 0.20 wt. % and less than or equal to 1.0 wt. %, a chlorine concentration of greater than or equal to 0.15 wt. % and less than or equal to 1.0 wt. %, and a mean sulfur composition in the aluminum plating film is 1.35 times±30% of a chlorine composition, on a basis of a ratio of atomic concentrations, in the aluminum plating film, wherein aluminum is the balance so that an aluminum concentration is 98 wt. % or lower, and a total concentration of the impurities is 2 wt. % or higher, and wherein the weight percentages are determined with respect to the total amounts of oxygen, carbon, sulfur, chlorine, and aluminum in the aluminum plating film.

2. A metallic member comprising:

a base material; and the aluminum plating film according to claim 1 on said base material.

3. The aluminum plating film according to claim 1, on which anodic oxidation has occurred.

4. An aluminum plating film formed by electroplating using a plating bath which is constituted by alkylsulfone as a solvent and an anhydrous aluminum trichloride (III) ($AlCl_3$) as a solute, with a micro-Vickers hardness of 300 or higher, wherein oxygen, carbon, sulfur and chlorine are contained as impurities, with an oxygen concentration of greater than or equal to 1.6 wt. % and less than or equal to 3.0 wt. %, a carbon concentration of greater than or equal to 0.45 wt. % and less than or equal to 0.8 wt. %, a sulfur concentration of greater than or equal to 0.35 wt. % and less than or equal to 1.0 wt. %, a chlorine concentration of greater than or equal to 0.30 wt. % and less than or equal to 1.0 wt. %, and a mean sulfur composition in the aluminum plating film is 1.35 times±30% of a chlorine composition, on a basis of a ratio of atomic concentrations, in the aluminum plating film, wherein aluminum is the balance so that an aluminum concentration is 97 wt. % or lower, and a total concentration of the impurities is 3 wt. % or higher, and wherein the weight percentages are determined with respect to the total amounts of oxygen, carbon, sulfur, chlorine, and aluminum in the aluminum plating film.

5. A metallic member comprising:

a base material; and the aluminum plating film according to claim 4 on said base material.

6. The aluminum plating film according to claim 4, on which anodic oxidation has occurred.

* * * * *